United States Patent [19]

Wood

[11] Patent Number: 4,589,246

[45] Date of Patent: May 20, 1986

[54] METHOD OF CLOSING AN END LOADING CARTON

[75] Inventor: Prentice J. Wood, Hapeville, Ga.

[73] Assignee: The Mead Corporation, Dayton, Ohio

[21] Appl. No.: 695,261

[22] Filed: Jan. 28, 1985

[51] Int. Cl.[4] ..... B65B 7/22

[52] U.S. Cl. ..... 53/491; 53/374

[58] Field of Search ..... 53/491, 484, 566, 374; 206/611, 427

[56] References Cited

U.S. PATENT DOCUMENTS

| | | | |
|---|---|---|---|
| 2,936,069 | 5/1960 | Dunning | 206/427 |
| 3,354,797 | 11/1967 | Hickin | 53/491 X |
| 3,377,767 | 4/1968 | Franz | 53/491 X |
| 4,216,861 | 8/1980 | Oliff | 206/611 X |
| 4,251,978 | 2/1981 | Beck | 53/491 |

*Primary Examiner*—James F. Coan

*Attorney, Agent, or Firm*—Rodgers & Rodgers

[57] ABSTRACT

A can carton of the end loading type includes foldably joined top, bottom and side walls forming a tubular structure, an end flap foldably joined to the end edges of the top, bottom and side walls, collapsible web structure disposed at each corner of the carton and foldably joined to the adjacent end of each of the adjacent end flaps which are foldably joined to the bottom and top walls and to the bevelled end edges of a projecting end portion of each side wall, the web structure being disposed in collapsed condition adjacent the end of the adjacent can, and a fold line interconnecting the projecting end portions of each of the side walls to facilitate manipulating the end closing structure of the carton to closed position after loading is completed, such manipulation comprising folding each projecting end portion of each side wall outwardly to draw the end flaps of the top and bottom walls inwardly and then folding the end flap at each end of each side wall upwardly thereby to collapse the web structure and to position such web structure in overlying relation relative to the adjacent can end.

3 Claims, 5 Drawing Figures

METHOD OF CLOSING AN END LOADING CARTON

TECHNICAL FIELD

This invention concerns an end loading carton having specially formed web structure at its corners whereby efficient closing of the carton ends is effected and significant economy in the use of material is achieved.

BACKGROUND ART

U.S. Pat. No. 4,216,861 issued Aug. 12, 1980 and owned by the assignee of this invention discloses a tubular carton in which corner web structure is provided to engage the sides of packaged cans in such manner as to enhance the strength and rigidity of the carton structure.

DISCLOSURE OF THE INVENTION

According to this invention in one form, an end loading can carton having top, bottom and side walls which are foldably interconnected to form a tubular structure is provided with projecting end portions having bevelled end edges and which are foldably joined to each end of each side wall together with end flaps which are foldably joined to the end edges of all of the walls and collapsible web structure disposed at each corner of the carton and foldably joined to the end edge of the adjacent end flap which is foldably joined to the carton top and bottom wall and which is also foldably joined to the bevelled end edge of the adjacent end projection of each side wall, the web structure being collapsed and disposed in contacting relation with the end of the adjacent packaged can when the carton is loaded and its end closing structure manipulated into closed condition.

BEST MODE OF CARRYING OUT THE INVENTION

Figure 1:
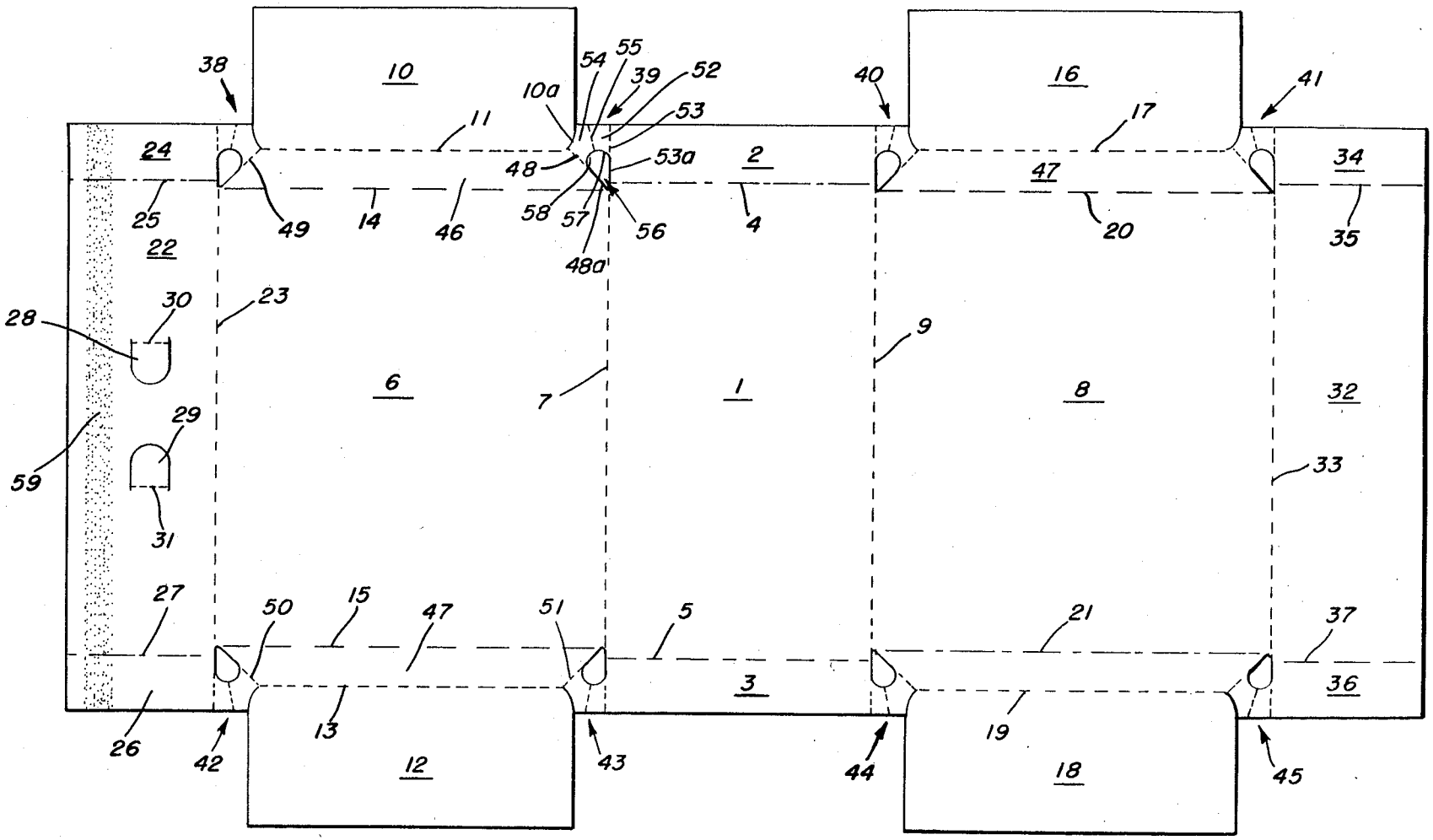
FIG. 1 is a plan view of a blank which incorporates the invention.

In the drawings the numeral 1 designates a bottom panel of the carrier to the end edges of which end flaps 2 and 3 are foldably joined along fold lines 4 and 5 respectively.

Side wall 6 is foldably joined to bottom wall 1 along fold line 7 while side wall 8 is foldably joined to bottom wall 1 along fold line 9.

An end flap 10 is foldably joined to the end edge of side wall 6 along fold line 11 while end flap 12 is foldably joined to side wall 6 along fold line 13. A flap manipulating fold line 14 is formed in side wall 6 adjacent the end edge 11 thereof, to define a projecting end portion of side wall 6 and a similar manipulating fold line 15 is formed in side wall 6 adjacent the end edge 13 thereof to define another projecting end portion of side wall 6.

An end flap 16 is foldably joined to side wall 8 along fold line 17 and a similar end flap 18 is foldably joined to side wall 8 along fold line 19. A manipulating fold line 20 is formed in side wall 8 near the end edge 17 thereof to define a projecting end portion of side wall 8 and a similar manipulating fold line 21 is formed in side wall 8 near the end edge 19 thereof to define another projecting end portion of side wall 8. A top panel 22 is foldably joined to the upper edge 23 of side wall 6 and an end flap 24 is foldably joined to top panel 22 along fold line 25. An end flap 26 is foldably joined along fold line 27 to an end edge of top panel 22. A pair of finger receiving tabs 28 and 29 are struck from top panel 22 and are foldably joined thereto along fold lines 30 and 31 respectively for cooperating with machine elements to facilitate setting up of the carton.

At the other end of the blank, a top panel 32 is foldably joined to the upper edge of side wall 8 along fold line 33 and end flap 34 is foldably joined to top panel 32 along fold line 35 while end flap 36 is foldably joined to top wall panel 32 along fold line 37.

Collapsible web structure is formed at each corner of the carton and is designated generally by the numerals 38–45. These web structures are of identical construction and only one such structure 39 is here described in detail.

The projecting end portions of side wall 6 are designated by the numerals 46 and 47. Projecting end portion 46 is formed with bevelled end edges 48 and 49. In like fashion, the projecting end portion 47 of side wall 6 which is disposed between fold lines 13 and 15 is provided with bevelled end edges 50 and 51. The side wall 8 is provided with end portions identical to 46 and 49 and a detailed description thereof is not deemed necessary.

Web structure 39 includes a first web panel 52 which is foldably joined to end flap 2 along fold line 53 together with a web panel 54 which is foldably joined to the projecting end portion 46 of top wall 6 along bevelled fold line 48. Web panels 52 and 54 are interconnected by fold line 55. An aperture 56 is formed in web structure 39 and one edge of aperture 56 is defined by the adjacent portion **48*a* of bevelled end 48 while another edge portion of aperture 56 is defined by an end portion 53*a* of end flap 2. The remainder of aperture 56 is of arcuate construction and is designated by the numerals 57 and 58. End flap 10 is separated from web panel 54 by an arcuate cut line 10*a***.

Figure 2:
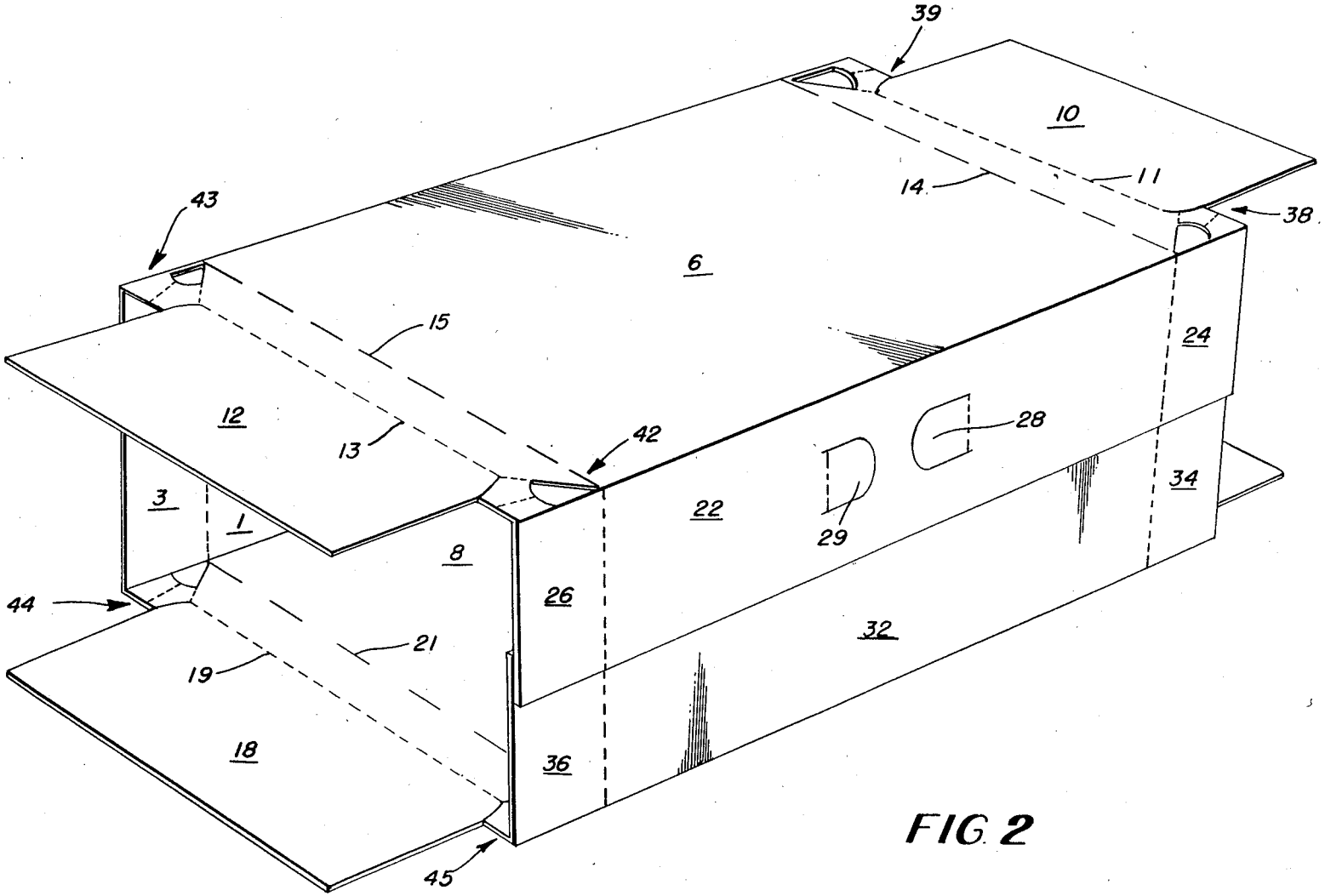
FIG. 2 is a perspective view of a tubular carton formed from the blank of FIG. 1 with its end flaps in outwardly projecting condition ready for end loading of cans to be packaged.

In order to manipulate the blank shown in FIG. 1 into the open ended condition depicted in FIG. 2, an application of glue is made to top panel 22 as indicated by the stippling at 59. Thereafter panel 8 and structure associated therewith is folded toward the left along fold line 9 and panel 22 is folded toward the right along fold line 23 to cause the outer edges of top wall panels 22 and 32 to become secured together in overlapping relationship. After the tube is formed, it is swung into set up condition as represented in FIG. 2 and cans are loaded through one or both ends thereof.

Figure 3:
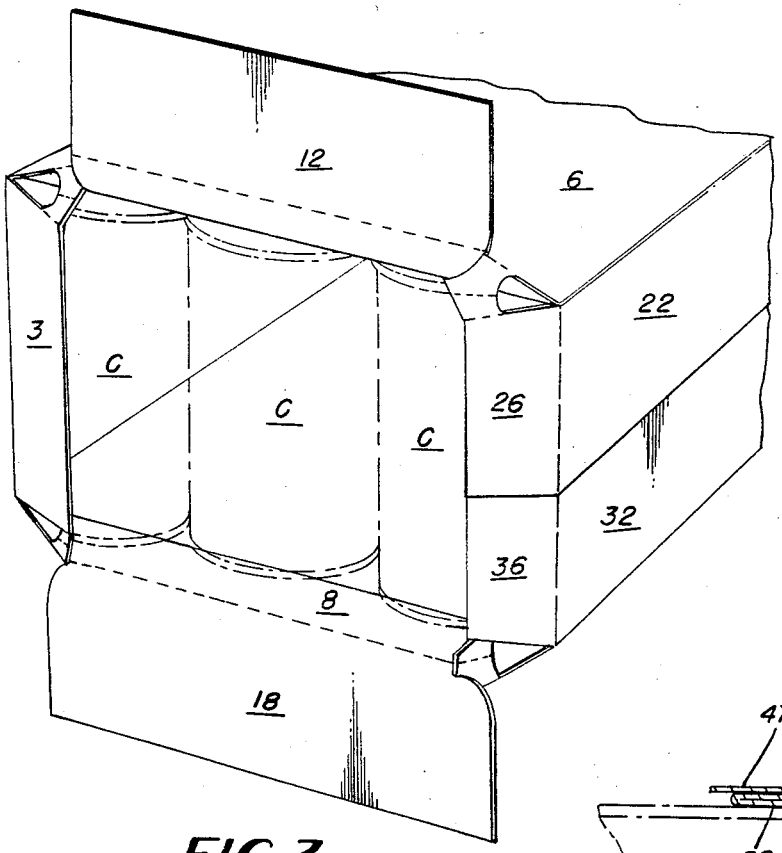
FIG. 3 is an enlarged fragmentary view of one end of the carton shown in FIG. 2 but which shows the end closure structure and associated parts in an intermediate stage of manipulation from open toward closed position.

Once the cans are loaded, the end flaps such as 12 and 18 are folded upwardly and downwardly along manipulating fold lines 15 and 21 respectively as represented in FIG. 3. This folding operation along manipulating fold lines 15 and 21 folds the end flaps 26,36 and 3 inwardly and simultaneously initiates the collapse of the web structures such as 42 and 43. Of course the operations depicted in FIG. 3 are effected simultaneously at both ends of the carton.

Figure 4:
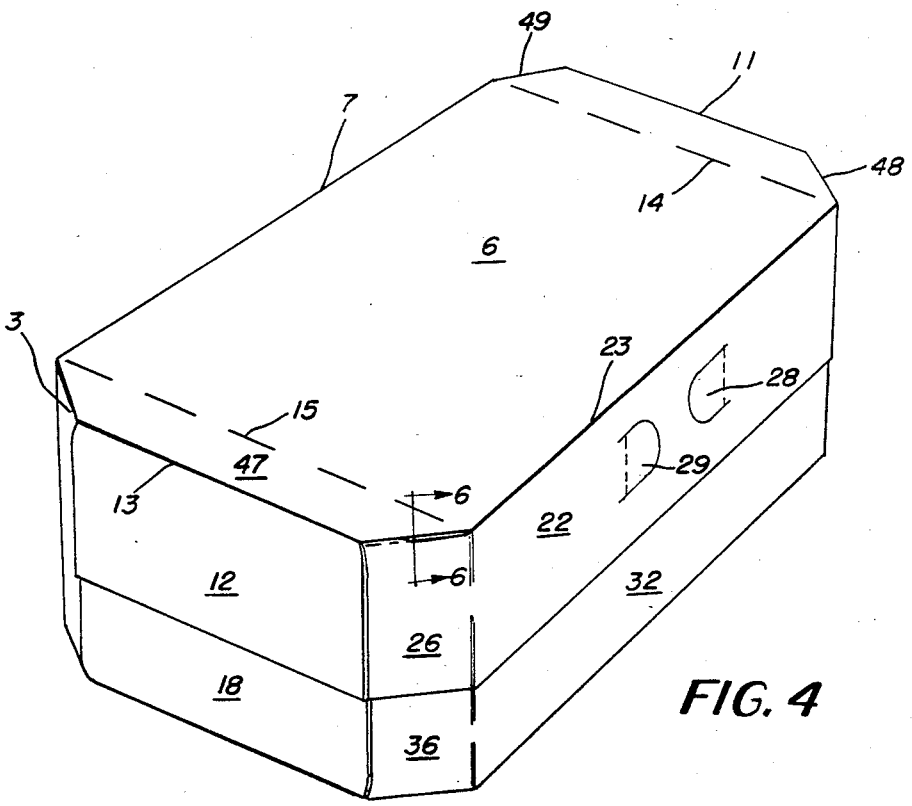
FIG. 4 is a perspective view of a fully set up loaded and closed carton formed from the blank of FIG. 1 and closed by the steps represented in FIGS. 2, 3, and 4.

Once the end flaps such as 26,36 and 3 as well as the corresponding flaps at the opposite end of the carrier are manipulated into the positions represented in FIG. 3, the end flap 12 is then folded downwardly along fold line 13 and the end flap 18 is folded upwardly along fold line 19. These flaps are then glued together along their overlapping edges as represented in FIG. 4 with the end flap 12 disposed in outer overlying relationship to the upper edge of end flap 18. The carton is then complete and appears as shown in FIG. 4.

Not only does the carton provided according to this invention embody substantial mechanical strength and durability, it is economical to produce because of the efficient nesting which is possible. For example, the panel such as end flap 10 of an adjacent blank to that depicted in FIG. 1 may be taken from the space between the adjacent ends of end flaps 12 and 18 and the panel 18 of FIG. 1 could be taken from that portion of another blank which would lie between the adjacent edges of end flaps 10 and 16. By this means no substantial wastage of material is necessary and substantial economy is thereby achieved.

Figure 5:
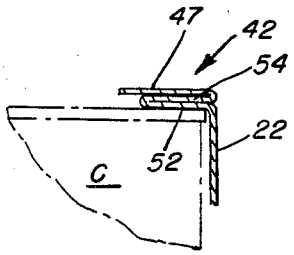
FIG. 5 is a fragmentary cross sectional view taken along the line designated 6—6 in FIG. 5.

Loaded can cartons such as that shown in FIG. 4 are normally transported and stored on pallets with tiers of cartons stacked one on top of another. Since can chimes are sharp, the chimes may cut the cartons and thus weaken or even destroy the associated carton. Since collapsed web structure of this invention is of double thickness as shown in FIG. 5 and is disposed adjacent the can ends, this web structure serves as a reinforcing cushion and thus tends to prevent cutting of the cartons.

INDUSTRIAL APPLICABILITY

By this invention an end loading tubular carton is provided which is mechanically strong and durable and which makes possible substantial economy in the use of material as compared with presently known practices.

I claim:

1. A method of closing the ends of an end loading tubular can carton having end flaps foldably joined to each end edge of the top and bottom walls and to a projecting end portion of the side walls and having collapsible web structure foldably joined to the end edges respectively of the end flaps foldably joined to each end of the top and bottom walls and to the adjacent projecting end portion of the side walls, the method comprising the steps of folding the projecting end portions of each side wall in a direction away from the associated end of the carton so as to cause the end flaps associated with the top and bottom walls to swing inwardly, folding the end flaps associated with the side walls inwardly and toward the adjacent ends of the carton during collapse of the web structures and to position the web structures in overlying relation relative to the ends of the adjacent cans, folding the end flaps which are associated with the side walls inwardly and into overlapping relation with each other at each end of the carton, and securing said overlapping ends together.

2. A method according to claim 1 wherein said projecting end portion of the carton side walls is defined by a fold line adjacent to and parallel with each end edge of each side wall.

3. A method according to claim 1 wherein each end edge of each of said projecting end portions is bevelled.

* * * * *